US007422363B2

(12) United States Patent
Parker

(10) Patent No.: US 7,422,363 B2
(45) Date of Patent: Sep. 9, 2008

(54) FLUID MIXING APPARATUS

(76) Inventor: Wilmer Parker, 112-47th Ave. SE., Salem, OR (US) 97301

( * ) Notice: Subject to any disclaimer, the term of this patent is extended or adjusted under 35 U.S.C. 154(b) by 132 days.

(21) Appl. No.: 11/065,087

(22) Filed: Feb. 22, 2005

(65) Prior Publication Data

US 2006/0187744 A1 Aug. 24, 2006

(51) Int. Cl.
*B01F 7/20* (2006.01)

(52) U.S. Cl. ..... 366/325.4; 366/129; 416/200 R

(58) Field of Classification Search ..... 366/129, 366/325.4, 330.1, 343, 263, 270, 325.5; 416/198 R, 416/200 R
See application file for complete search history.

(56) References Cited

U.S. PATENT DOCUMENTS

| | | | | | |
|---|---|---|---|---|---|
| 606,384 | A | * | 6/1898 | Greise | 122/411 |
| 960,680 | A | | 6/1910 | Nall | |
| 2,183,763 | A | * | 12/1939 | Brown | 96/196 |
| 2,189,146 | A | * | 2/1940 | Little | 165/73 |
| 2,235,604 | A | * | 3/1941 | Brumagim | 366/325.4 |
| 2,347,195 | A | * | 4/1944 | Huff | 366/169.2 |
| 2,733,900 | A | | 2/1956 | Wobensmith | |
| 2,799,485 | A | | 7/1957 | Silverman | |
| 2,896,925 | A | * | 7/1959 | Place | 416/201 R |
| 3,166,303 | A | | 1/1965 | Chapman | |
| 3,333,831 | A | * | 8/1967 | Chapman | 366/129 |
| 3,704,007 | A | | 11/1972 | Kroeger | |
| 3,733,645 | A | | 5/1973 | Seiler | |
| 3,907,459 | A | | 9/1975 | Guedel | |
| 4,054,272 | A | | 10/1977 | Cooke | |
| 4,176,797 | A | | 12/1979 | Kemp | |
| 4,260,267 | A | | 4/1981 | Walton | |
| 4,480,926 | A | | 11/1984 | Lattery, Jr. et al. | |
| 4,877,208 | A | | 10/1989 | Kennard, Jr. | |
| 5,073,033 | A | | 12/1991 | Klepeis | |
| 5,090,816 | A | | 2/1992 | Socha | |
| 5,261,745 | A | | 11/1993 | Watkins | |
| 5,289,731 | A | | 3/1994 | Womack | |
| 5,470,148 | A | | 11/1995 | Gorr et al. | |
| 5,984,518 | A | | 11/1999 | King et al. | |
| 6,315,441 | B2 | | 11/2001 | King | |
| 6,616,318 | B1 | | 9/2003 | LeBlanc et al. | |
| 2003/0053838 | A1 | | 3/2003 | Whitney | |
| 2004/0151060 | A1 | | 8/2004 | Hutchinson | |

* cited by examiner

*Primary Examiner*—David L Sorkin
(74) *Attorney, Agent, or Firm*—Chernoff, Vilhauer, McClung & Stenzel, LLP

(57) ABSTRACT

An apparatus for mixing fluid.

10 Claims, 2 Drawing Sheets

FLUID MIXING APPARATUS

BACKGROUND OF THE INVENTION

The present invention relates to an apparatus for mixing fluid.

There are at present several types of mixing attachments used for mixing fluid such as paint. Typically, these attachments include means for attachment to a power tool such as a drill or other tool that causes the mixing attachment to rotate rapidly while immersed in the fluid to be mixed. The fluid is usually contained in a container. These attachments will also usually include at their distal end, i.e. the end of the attachment away from that which attaches to the power tool, lateral blades, cylinders, or other such members that push the fluid while the attachment rotates, thereby assisting in the mixing process.

Such existing mixing attachments are deficient in several respects. First, these attachments tend to be inefficient in that, in order to mix the fluid, they primarily rely upon the centrifugal forces caused by the rotational motion imparted to the fluid. Unfortunately, such centrifugal forces tend to merely push the fluid to the outer boundaries of the container it is in, and the resulting turbulence mixes the fluid rather slowly so that a great deal of time is required to thoroughly mix the fluid. Second, these attachments are relatively ineffective at drawing fluid upwards from the bottom of the container, resulting in a portion of the fluid in the container not being mixed thoroughly. Finally, these mixing attachments often not effective at mixing viscous fluids such as concrete because the attachments lack the sufficient capacity to deliver enough power to mix such fluids.

What is desired then, is an improved mixing apparatus capable of mixing fluid in a shorter period of time, capable of drawing fluid upwards from the bottom of a container, and capable of mixing relatively viscous fluids.

BRIEF DESCRIPTION OF THE SEVERAL DRAWINGS

DETAILED DESCRIPTION OF PREFERRED EMBODIMENTS

Figure 1A:
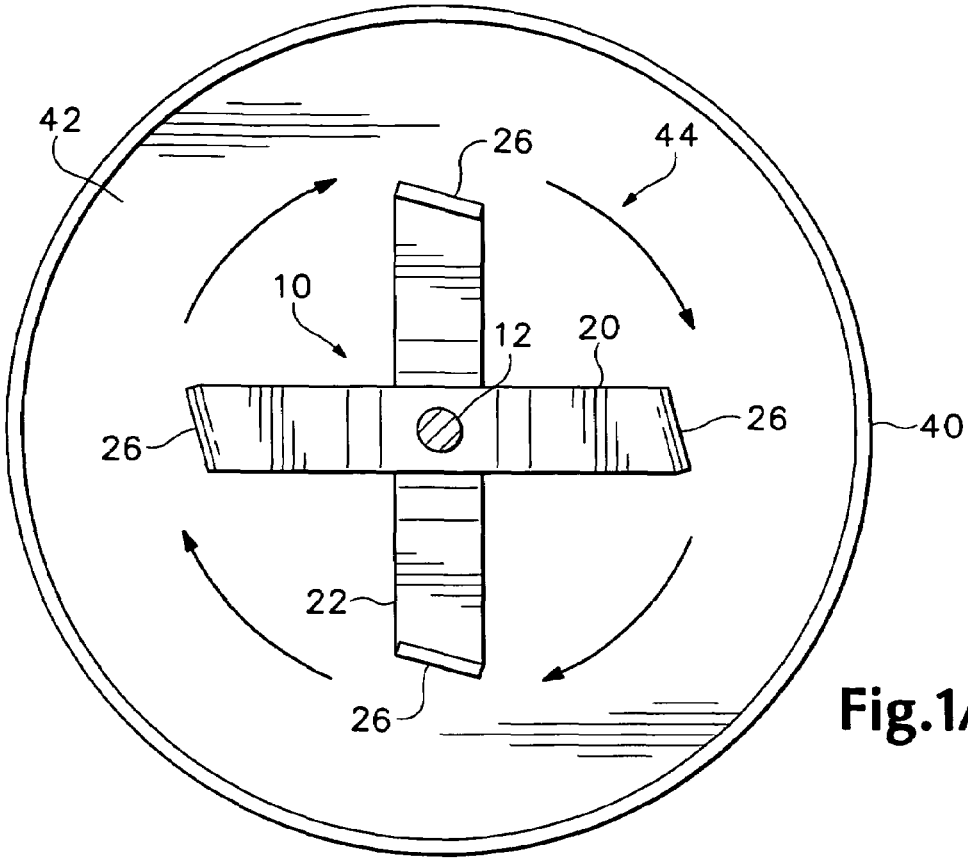
FIG. 1A shows a top view of a container that contains fluid being mixed in a desired fluid movement.
Figure 1B:
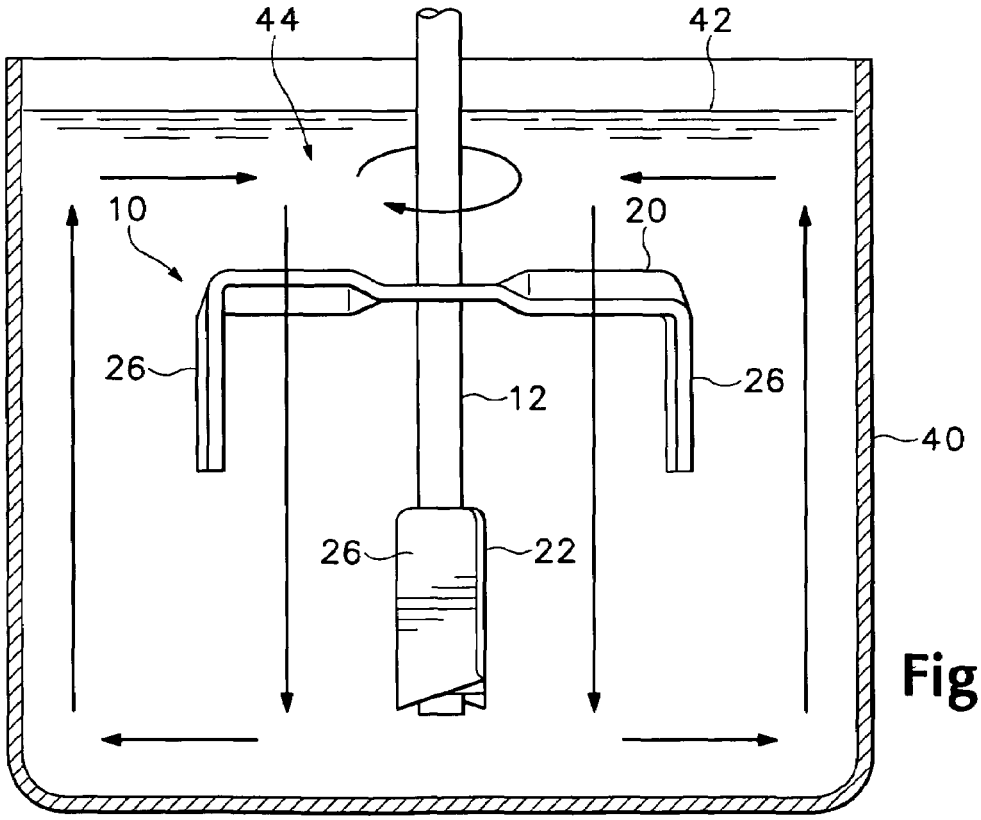
FIG. 1B shows a side cross-section of the container of FIG. 1A.

FIGS. 1A and 1B shows a mixing apparatus 10 designed in accordance with the present invention having a mixing portion 16 (shown in FIG. 2) immersed in a container 40 of fluid 42. The term fluid is intended to convey its ordinary meaning, i.e. material that deforms in response to a shear force. A fluid may be, but is not necessarily liquid. As indicated previously, existing mixing attachments inserted in such a container 40 would be inefficient at mixing the fluid 42 because such attachments rely upon the turbulence created by the centrifugal force of the rotational motion (indicated by the arrow in FIG. 1A) imparted to the fluid 42 by the attachment. This centrifugal force tends to push fluid outward as the fluid 42 spins, but aside from the resulting turbulence, there are little actual mixing forces.

The present inventor realized that, to better mix the fluid 42 in the container 40, a mixing attachment should impart a folding motion to the fluid as generally indicated by the arrows in FIG. 1B, and this folding motion should preferably have a component caused principally by other than centrifugal force from rotational movement. More specifically, if the attachment were to impart upward fluid movement proximate the periphery of the container 40, downward fluid movement proximate the central vertical axis of the container 40, inward fluid movement proximate the surface of the fluid 42, and outward fluid movement proximate the lower boundary of the container 40, the fluid would be mixed much more rapidly and much more thoroughly. Moreover, this described folding motion should have a component not caused by rotational movement of the fluid so that the folding motion may overcome the outward acceleration of the fluid.

It should be understood that, although not quite as effective, a folding motion the reverse of what was just described would also mix fluid more efficiently than existing mixing attachments. That is to say, if the attachment were to impart upward fluid movement proximate the central vertical axis of said container 40, downward fluid movement proximate the periphery of the container 40, inward fluid movement proximate the lower boundary of the container 40, and outward fluid movement proximate the surface of the fluid 42, the fluid would be also mixed much more rapidly and much more thoroughly.

Figure 2:
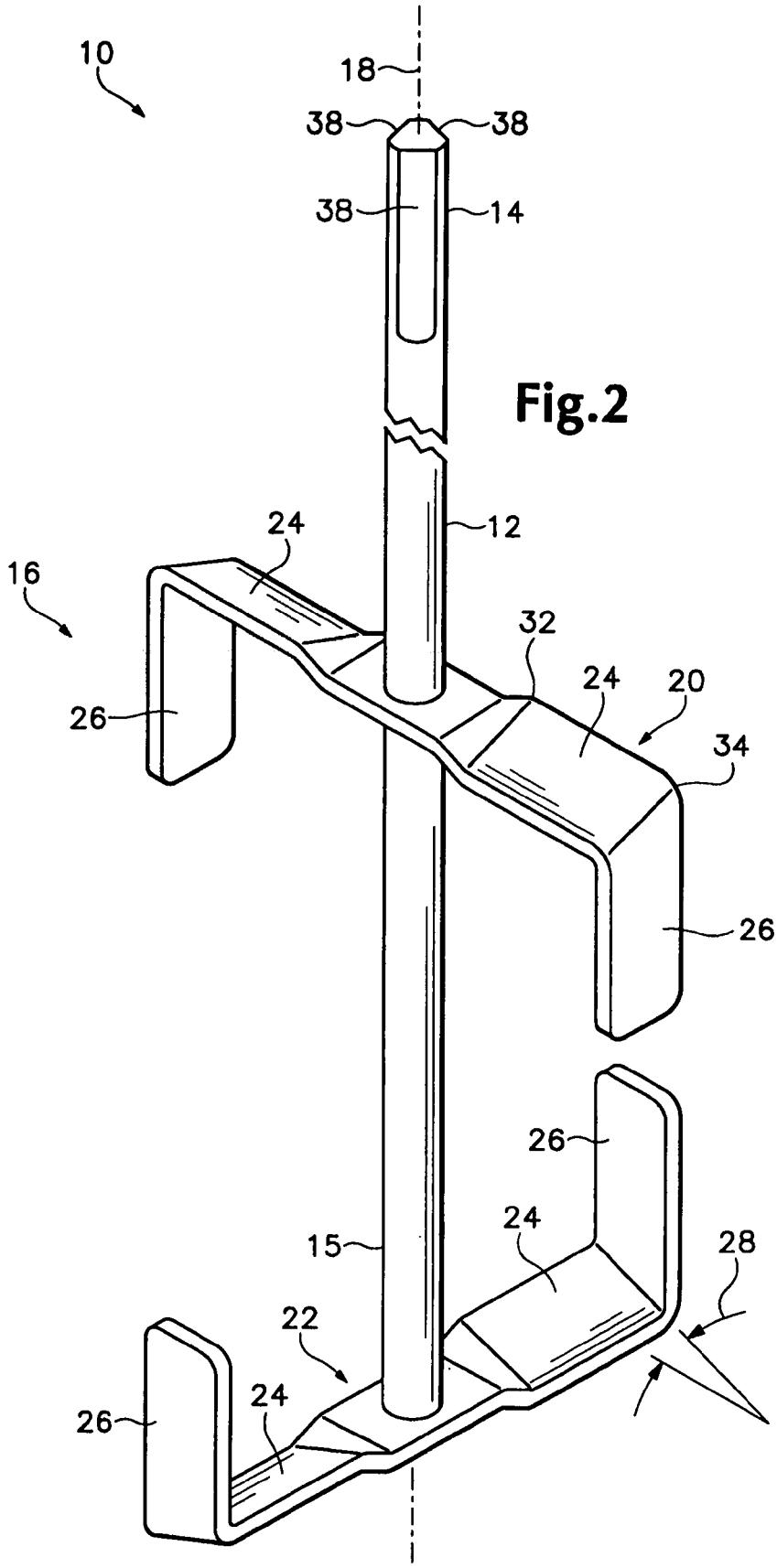
FIG. 2 shows an isometric view of a mixing apparatus.

Referring to FIG. 2, the mixing apparatus 10 may include a generally cylindrical and elongate shaft 12 with a first end 14 attachable to a power tool such as a drill capable of imparting rotational movement to the shaft 12. Flattened surfaces 38 may facilitate attachment to a power tool. At the second end 15, or distal end of the shaft 12 is a mixing portion 16 capable of being immersed in fluid while the first end 14 is not immersed during the mixing process. The mixing portion may comprise a first blade 20 and a second blade 22 each comprising a horizontal member 24 having an inner end 32 mounted to the shaft 12 and a vertical member 26 mounted to the outer end 34 of the horizontal member 24. Preferably, both the horizontal member 24 and the vertical member 26 act as vanes when the shaft 12 is rotated, i.e. they push the fluid in a manner that produces the desired folding motion described previously. This motion is achieved by the apparatus 10 because the vanes 24 and 26 are tilted with respect to horizontal and vertical axes, through the vanes, respectively.

As may be seen from this figure, as the apparatus 10 is rotated in a clockwise direction, the vane 26 of the first blade will pull fluid inward towards the longitudinal axis 18 of the shaft while the vane 26 of the second blade 22 will push fluid outward toward the periphery of the container 40 holding the fluid 42. Combined, these two vanes tend to form a vortex 44 (shown in FIG. 1B) stronger than that which would ordinarily be formed merely from rotational movement of the fluid. This vortex will, in turn, draw fluid proximate the shaft 12 in a downward direction—a movement also facilitated by gravity. The vanes 24, however, are both tilted in a direction tending to draw fluid in an upward direction. This serves two purposes. First, at the periphery of the container 40, the vanes 24 produce an upward motion because the combined force imparted to the fluid at that location is sufficient to overcome the combined strength of the vortex, which is weaker at the periphery than the central axis of the container 40, and gravity. Second, the combined force of the vanes 24 will tend to pull fluid upward from the bottom of the container 40 into the vortex 44. It should be understood that, if the shaft 12 were rotated in a counterclockwise direction, the reverse motion—previously described—would result.

Preferably, the vanes 24 and 26 are tilted at an angle 28 with respect to the horizontal or vertical axes, respectively of between 5 and 30 degrees. If the angle 28 is less than 5 degrees, the resulting vortex is too weak to produce the desired folding motion. If the angle 28 is greater than 30 degrees, the force imparted to the vanes, and hence the apparatus 10, becomes difficult to control manually. Through experimentation, the inventor has discovered that an angle 28 between 10 and 20 degrees is an ideal compromise between mixing strength and manageability. In the preferred embodiment herein described, the angle 28 is 15 degrees.

As shown in FIG. 2, each blade 20 and 22, respectively, has two horizontal members 24 and two vertical members 26 diametrically opposed to one another. Though this configuration assists in stability during manual operation, it is not strictly necessary. For example, some embodiments of the disclosed mixing apparatus may include blades 20 and 22 each having only one horizontal member 24 and one vertical member 26. Further, also as shown in FIG. 2, the apparatus 10 may be configured so that a horizontal member of the first blade 20 has a length oriented at an approximate right angle with a horizontal member of the second blade 22 when viewed along the shaft 12.

It should be understood that the description of the fluid motion resulting from clockwise and counterclockwise rotation, respectively, of the apparatus 10 is a result of an arbitrary design choice and may easily be interchanged simply by reversing the tilt of each vane.

It should also be understood that the described mixing apparatus 10 is useful in mixing fluids not contained within a container. For example, it may be desired to place material in a body of water, like a lake, and use the disclosed apparatus 10 to disperse or mix the material. In that context, the foregoing references to the boundaries of the container 40 are not essential to the invention described in this specification.

The terms and expressions that have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims that follow.

The invention claimed is:

1. A fluid mixing apparatus selectively insertable in a container of fluid, said apparatus comprising:

(a) a longitudinal shaft;

(b) a first blade transversely mounted to said shaft at a first location and having a first blade horizontal member and a first blade vertical member, said horizontal member shaped to push fluid upward when said shaft is rotated in said container in a rotational direction and said first blade vertical member shaped to push fluid inward when said shaft is rotated in said rotational direction; and (c) a second blade transversely mounted to said shaft at a second location, different than said first location, and having a second blade horizontal member and a second blade vertical member, said horizontal member shaped to push fluid upward when said shaft is rotated in said container in said rotational direction and said vertical member shaped to push fluid outward when said shaft is rotated in said rotational direction.

2. The apparatus of claim 1 where said shaft has a first end securable to a power tool capable of causing rotation of said shaft.

3. The apparatus of claim 2 where said first blade is mounted to said shaft closer to said first end than is said second blade.

4. The apparatus of claim 1 where each of said horizontal and vertical members are vanes.

5. The apparatus of claim 4 where each said vane is tilted within the range of 5 to 30 degrees with respect to an axis through said vane.

6. The apparatus of claim 4 where each said vane is tilted within the range of 10 to 20 degrees with respect to an axis through said vane.

7. The apparatus of claim 4 where each said vane is tilted 15 degrees with respect to an axis through said vane.

8. The apparatus of claim 1 where each said first and second blades have two said horizontal members opposed to one another diametrically with respect to said shaft and two said vertical members opposed to one another diametrically with respect to said shaft.

9. The apparatus of claim 8 where the respective horizontal members of each blade have lengths oriented at an approximate right angle with one another.

10. The apparatus of claim 1 where each said horizontal member has an inner end mounted to said shaft and an outer end proximate a respective said vertical member.

* * * * *